US008590723B2

(12) United States Patent
Sooth

(10) Patent No.: US 8,590,723 B2
(45) Date of Patent: Nov. 26, 2013

(54) CONTAINER SEAL, CONTAINER LID AND CONTAINER

(75) Inventor: Jurgen Sooth, Kaufbeuren (DE)

(73) Assignee: Euro-Cap GmbH, Schwaigern (DE)

( * ) Notice: Subject to any disclaimer, the term of this patent is extended or adjusted under 35 U.S.C. 154(b) by 1654 days.

(21) Appl. No.: 10/529,093

(22) PCT Filed: Sep. 24, 2003

(86) PCT No.: PCT/EP03/10640

§ 371 (c)(1),
(2), (4) Date: Nov. 27, 2006

(87) PCT Pub. No.: WO2004/028917

PCT Pub. Date: Apr. 8, 2004

(65) Prior Publication Data

US 2010/0219197 A1 Sep. 2, 2010

(51) Int. Cl.
*B65D 51/18* (2006.01)

(52) U.S. Cl.
USPC ..... 220/254.3; 220/258.4

(58) Field of Classification Search
USPC ..... 220/254.3, 359.2, 270, 269, 258.4, 781, 220/254.2, 254.1, 254.4, FOR. 203; 53/133.2, 133.4; 229/125.14, 123.3
See application file for complete search history.

(56) References Cited

U.S. PATENT DOCUMENTS

| | | | | |
|---|---|---|---|---|
| 2,885,084 | A | | 5/1959 | Rocca |
| 3,281,024 | A | * | 10/1966 | Henchert et al. ..... 222/484 |
| 4,544,079 | A | | 10/1985 | Elrick |
| 4,930,683 | A | * | 6/1990 | Farber ..... 229/125.09 |
| 4,986,465 | A | * | 1/1991 | Jacobsson et al. ..... 229/123.3 |
| 5,495,706 | A | | 3/1996 | Bjorck et al. |
| 5,887,743 | A | * | 3/1999 | Stahlecker et al. ..... 220/270 |
| 5,938,056 | A | * | 8/1999 | Ma ..... 215/237 |
| 6,003,712 | A | * | 12/1999 | Mogard et al. ..... 220/259.5 |

FOREIGN PATENT DOCUMENTS

| | | |
|---|---|---|
| DE | 94 20 437 | 3/1995 |
| DE | 695 20 572 | 7/2001 |
| DE | 100 17 467 | 9/2001 |
| DE | 102 44 349 | 4/2004 |
| DE | 103 12 237 | 4/2004 |
| EP | 0 577 865 | 1/1994 |
| EP | 0 760 339 | 3/1997 |
| EP | 1 038 784 | 9/2000 |
| FR | 22 33 239 | 1/1975 |
| WO | WO97/33797 | 9/1997 |

* cited by examiner

*Primary Examiner* — Jeffrey Allen
(74) *Attorney, Agent, or Firm* — Caesar, Rivise, Bernstein, Cohen & Pokotilow, Ltd.

(57) ABSTRACT

The invention relates to a container seal, in particular for a milk container (7'), whereby said container seal may be mounted in a container lid (6') and manually operated without tools. According to the invention, the container seal is at least partly made from plastic and may be inserted in a cut-out in the container lid (6'), whereby the container seal seals the cut-out in the container lid (6') and comprises a pouring opening. The invention further relates to a corresponding container lid (6) and a container with said container seal.

12 Claims, 9 Drawing Sheets

CONTAINER SEAL, CONTAINER LID AND CONTAINER

BACKGROUND

Embodiments of the present invention relate to a can closure, particularly for a milk can, a can lid and a can having a can closure and/or can lid.

Typical condensed milk cans are typically opened by piercing a pouring opening in the can lid near the edge and a ventilation opening on the diametrically opposing side.

Known condensed milk cans of this type have the problem of the can fold seam projecting next to the pouring opening at the can edge, which obstructs clean pouring of the condensed milk and thus makes the desired metering of the condensed milk more difficult. In addition, condensed milk residues may collect on the can edge, which is unhygienic and impairs the visual impression of the condensed milk can. Finally, in the known condensed milk cans, the pouring opening or the ventilation opening may clog, which requires renewed opening.

Furthermore, beverage cans are known for beer or caffeinated soft drinks, for example, which have a ring-pull closure or a press-in closure. For this purpose, a typically triangular wall part is provided in the can lid, which is delimited from the remaining can lid by a weakening line and may be torn open using a tab or pressed into the beverage can in order to expose a pouring opening in the can lid. Press-in or ring-pull closures of this type are not used in condensed milk cans, however, since the resulting pouring openings would typically be too large. In addition, the can fold projecting at the can edge would also lead to the problems described at the beginning with a press-in closure or ring-pull closure of this type.

A pourer for Europacks, which has a closure bottom having a pouring opening and a foldable closure top, is known from DE 100 17 467 A1.

SUMMARY

An embodiment of the present invention is therefore based on the object of providing a can closure which allows clean pouring from a condensed milk can and prevents contamination by adhering condensed milk residues.

The object is achieved, for example, by a can closure, a can lid, and a corresponding can according to the invention.

The present invention comprises the general technical teaching of providing a can closure which at least partially comprises plastic and has a pouring opening that may be opened manually by user without tools, the pouring opening preferably being spaced apart from the can lid.

The positioning of the pouring opening spaced apart from the can lid offers the advantage that clean pouring is possible and contamination of the can lid by residues of the liquid poured out is prevented.

In contrast, manufacturing the can closure according to the present invention from plastic offers the advantage that the closure may be inserted into a cutout in the can lid and seals the cutout at the same time.

If the can closure is manufactured from plastic, the can bottom preferably comprises two components which have different hardnesses. The softer component of the can bottom is used in this case as a gasket and presses against the edge of the cutout in the mounted state in the can lid.

For this purpose, the gasket preferably not only presses against the edge of the cutout positioned in the can lead, but rather encloses the edge of the cutout, through which the edge of the cutout is protected from corrosion. It is to be noted in this context that the can sheet metal is typically coated with a protective lacquer layer before processing. When the cutout is stamped into the can lid, this protective lacquer layer is damaged at the edge of the cutout, however, which may lead to corrosion there. In this variation of the present invention, corrosion at the edge of the cutout in the can lid is thus advantageously prevented because the cut edge is enclosed by the gasket of the can closure according to the present invention.

Polyethylene (PE) and polypropylene (TP) are especially advantageously suitable as a material for the can closure according to the present invention, however, the present invention is not restricted to these plastics in regard to the material for the can closure, but rather may also be implemented using other plastics.

In a preferred exemplary embodiment of the present invention, the can closure has a closure bottom and a closure lid, the closure bottom being insertable into a cutout in the can lid and able to be connected to the can lid in a form-fitting way, while the closure lid is connected by a joint to the closure bottom and is pivotable from a transport position into a usage position. For this purpose, a pouring opening is positioned in the closure bottom and the closure lid has means to open the pouring opening in the usage position of the closure lid. For this purpose, i.e., for opening the can closure, the closure lid is preferably folded onto the closure bottom, the pouring opening positioned in the closure bottom automatically being opened.

The pouring opening in the closure bottom is preferably closed before the initial opening by a cover which has at least one intended breaking point. The closure lid then breaks this intended breaking point upon the initial pivoting from the transport position into the usage position, through which the pouring opening in the closure bottom is exposed.

The breaking of the intended breaking point in the closure bottom is preferably performed using a piercing rib, which is positioned on the bottom of the closure lid and presses against the cover of the pouring opening positioned in the closure bottom when the closure lid is pivoted out of the transport position into the usage position.

This piercing rib preferably has a bevel on the side facing toward the joint, the height of the piercing rib falling along the bevel toward the joint.

The cover of the pouring opening positioned in the closure bottom is prevented from tearing off completely and possibly falling into the can in the usage position of the closure lid.

In addition, the cover of the pouring opening positioned in the closure bottom is held in a pivoted position, in which the pouring opening in the closure bottom always remains open, by the bevel of the piercing rib.

In addition, the piercing rib attached in the closure lid is preferably used as a handle to pivot the closure lid from the transport position into the usage position.

The closure bottom may have a peripheral, preferably grooved depression for attachment to the can lid, in which the mouth edge of a cutout positioned in the can lid engages in a form-fitting way.

However, it is more favorable for manufacturing to connect the closure bottom to the can lid using a plastic injection procedure.

In addition, there is also the possibility that the closure bottom is bonded to the can lid by an ultrasonic weld.

The can closure according to the present invention preferably has a surface contour on its bottom or on the lower side of the closure bottom, in order to produce a form-fitting, intimate connection to a corresponding surface contour on the can lid during a plastic injection procedure. A surface contour of this type may comprise small protrusions, depressions, or holes, for example, which are positioned in the can lid at the edge of the cutout for the closure bottom.

Furthermore, after the closure lid in the can closure according to the present invention is pivoted from the transport position into the usage position, it preferably automatically remains in the usage position. This may be achieved, for example, if the closure lid forms a press fit with the closure bottom. However, it is also alternatively possible that the closure bottom and the closure lid have catch elements in order to form a catch connection between the closure bottom and the closure lid in the usage position of the closure lid, so that the closure lid remains in the usage position automatically.

In addition, the can closure according to the present invention is preferably recloseable after the initial opening. For this purpose, a closure flap may be provided, which is positioned on the closure lid and may be pivoted in relation to the closure lid by a joint, such as a film hinge, for example.

However, the present invention comprises not only the can closure according to the present invention described above, but rather also an appropriately adapted can lid, which has a cutout for receiving the closure bottom and a depression for receiving the closure lid in its transport position.

The depression for the closure lid is preferably sufficiently large for this purpose that the closure lid does not project upward above the can edge in the mounted state in the transport position. A design of this type of the can closure and the associated can lid is advantageous since the filled cans may thus be stacked one on top of another without the can closure increasing the stack height or impairing the ability to be stacked.

Preferably, in the can lid according to the present invention, a surface contour is provided at the edge of the cutout for the closure bottom, in order to produce a form-fitting, intimate connection with a corresponding surface contour on the closure bottom during a plastic injection procedure. A surface contour of this type may comprise, for example, protrusions, depressions, or holes which are positioned at the edge of the cutout for the closure bottom.

Finally, the present invention also comprises a can having a can lid of this type and/or a can closure according to the present invention.

BRIEF DESCRIPTION OF THE DRAWINGS

Other advantageous refinements of the present invention are characterized in the dependant claims or will be explained in greater detail in the following together with the description of the preferred exemplary embodiment of the present invention on the basis of the figures.

DESCRIPTION

Figure 1:
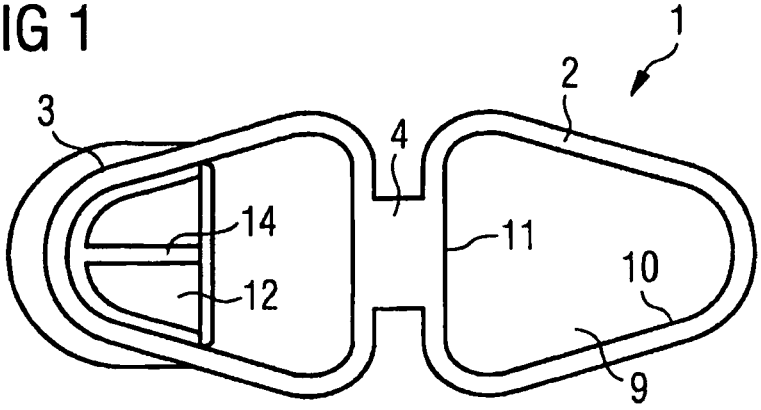
FIG. 1 shows a can closure according to the present invention in the opened state in a top view.

FIGS. 1 through 5 show a can closure 1 manufactured from plastic, which essentially comprises a closure bottom 2 and a closure lid 3.

The closure bottom 2 is connected via a joint 4 to the closure lid 3, the joint 4 comprising a film hinge.

During assembly, the closure bottom 2—as will be explained later—is attached in a cutout 5, which is tailored to its shape, within a can lid 6 of a can 7.

Figure 2:
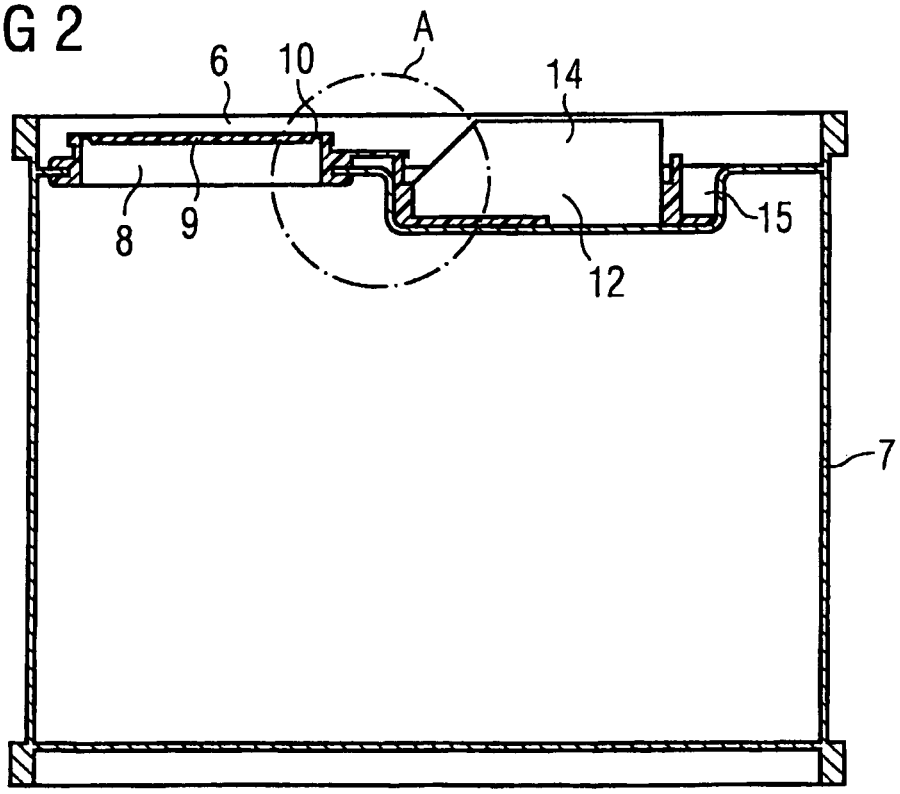
FIG. 2 shows a cross-sectional view of a can having the can closure according to the present invention from FIG. 1 in a transport position.
Figure 3:
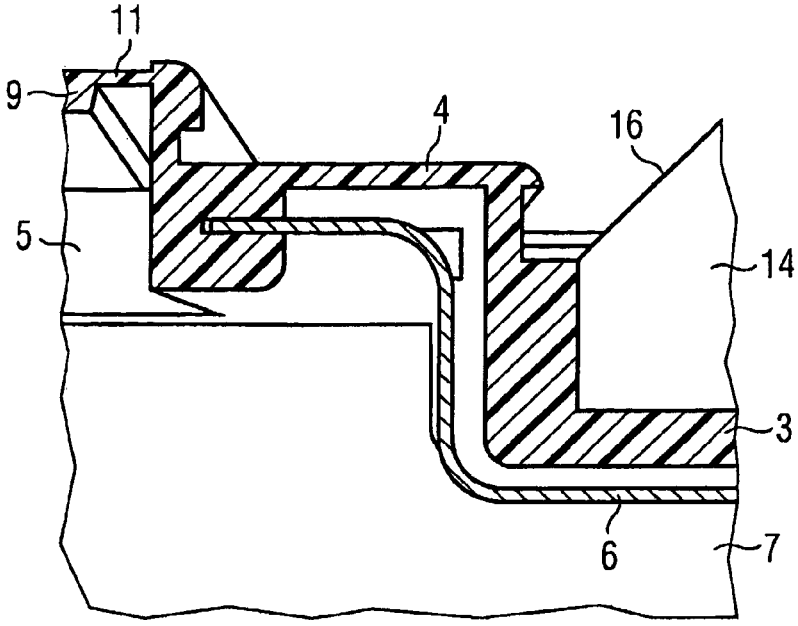
FIG. 3 shows the region A from FIG. 2 in an enlarged cross-sectional view.

The closure bottom 2 has a pouring opening 8, which is provided with a cover 9 in the form of a piercing area in the transport state of the can 7 (see FIG. 2). This cover 9 is connected in its regions adjoining the pouring opening 8 to the closure 2 via thin-walled intended break points 10, while a region of the cover 9 diametrically opposite the pouring opening 8 is designed as a film hinge 11 and acts as a joint after the piercing.

The closure lid 3 is also provided with a pouring opening 12, which is closeable again in the usage state of the can 7 using a linked closure flap 13. In the central region of the pouring opening 12 in the closure lid 3, a piercing rib 14 is positioned, which overlaps the pouring opening 12 perpendicularly and whose function will be discussed later.

FIG. 2 shows the can closure 1 integrated into the can lid 6 of the can 7, the cover 9 still being connected to the closure bottom 2. As may also be seen from this figure, the cutout 5 is located in the can lid 6, into which the closure bottom 2 is introduced using an injection procedure and is therefore supported in a form-fitting way in the can lid 6. The possibility arises of providing small protrusions and/or depressions or small holes on the inner contours of the cutout 5 for this purpose, in order to produce an intimate bond between the closure bottom 2 and the can lid 6.

The can lid 6 also has a depression 15 tailored to the contours of the closure lid 3, into which the closure lid 3 is introduced in the transport state of the can 7. It is thus possible to stack multiple cans 7 one on top of another for transport purposes, without the closure 1 having an interfering effect on the stack height. The depression 15 is therefore deep enough that the closure lid 3 does not project above the edge of the can 7 in the transport position.

Figure 4:
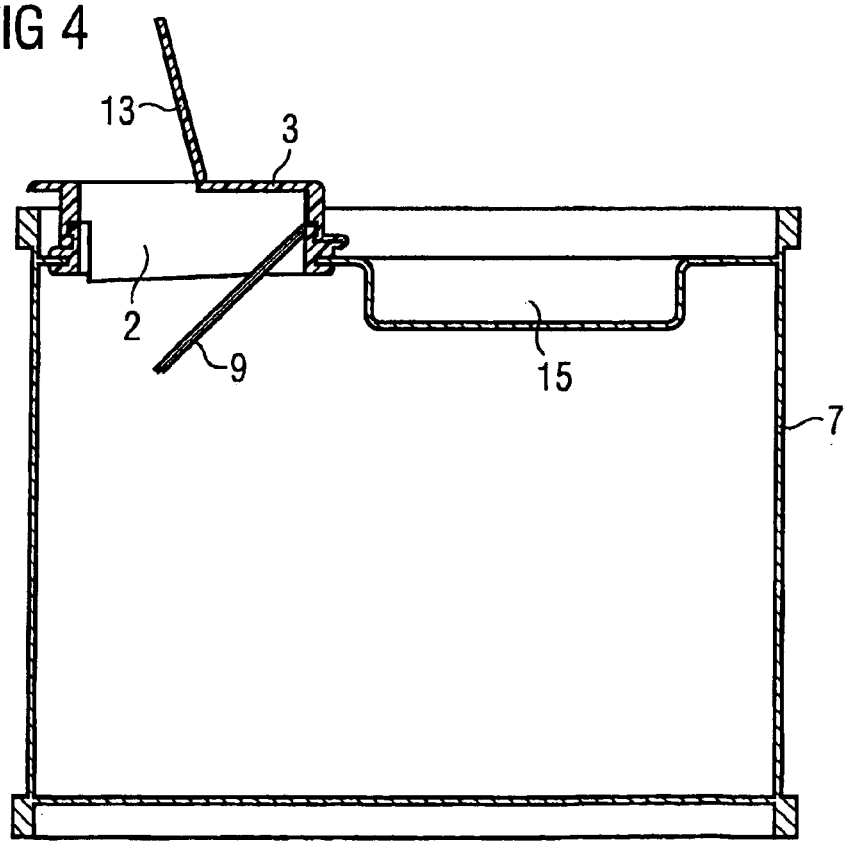
FIG. 4 shows a cross-sectional view of the can from FIG. 2 in a usage position with the can closure opened.
Figure 5:
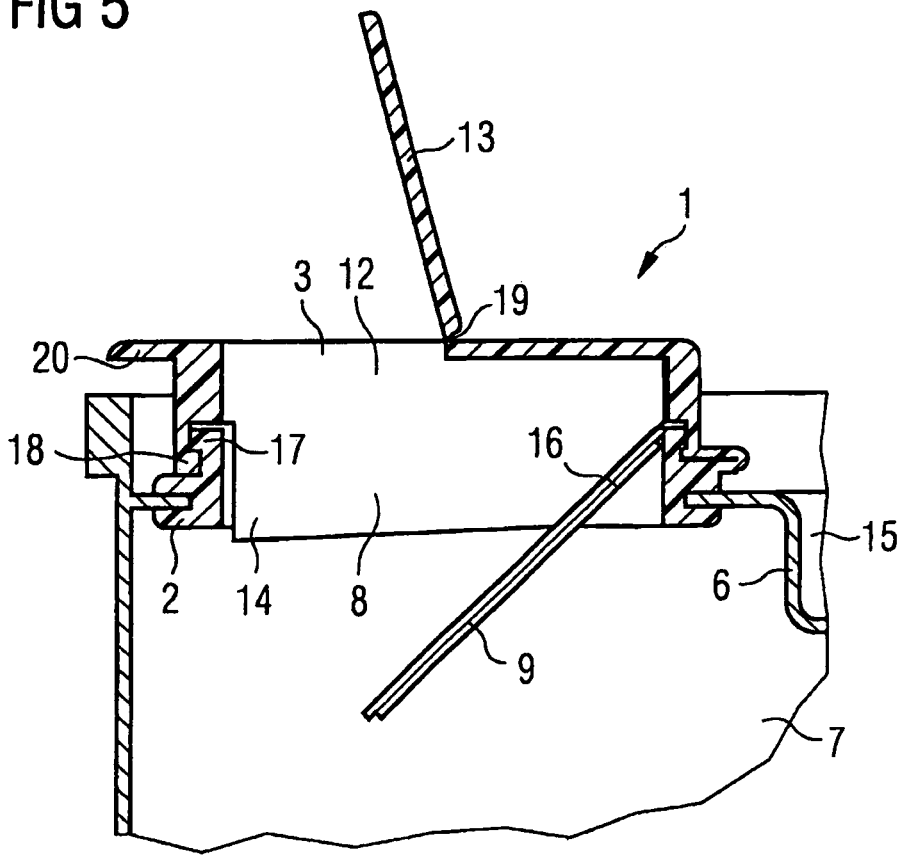
FIG. 5 shows an enlarged cross-sectional view of the can closure from FIG. 4.
Figure 6:
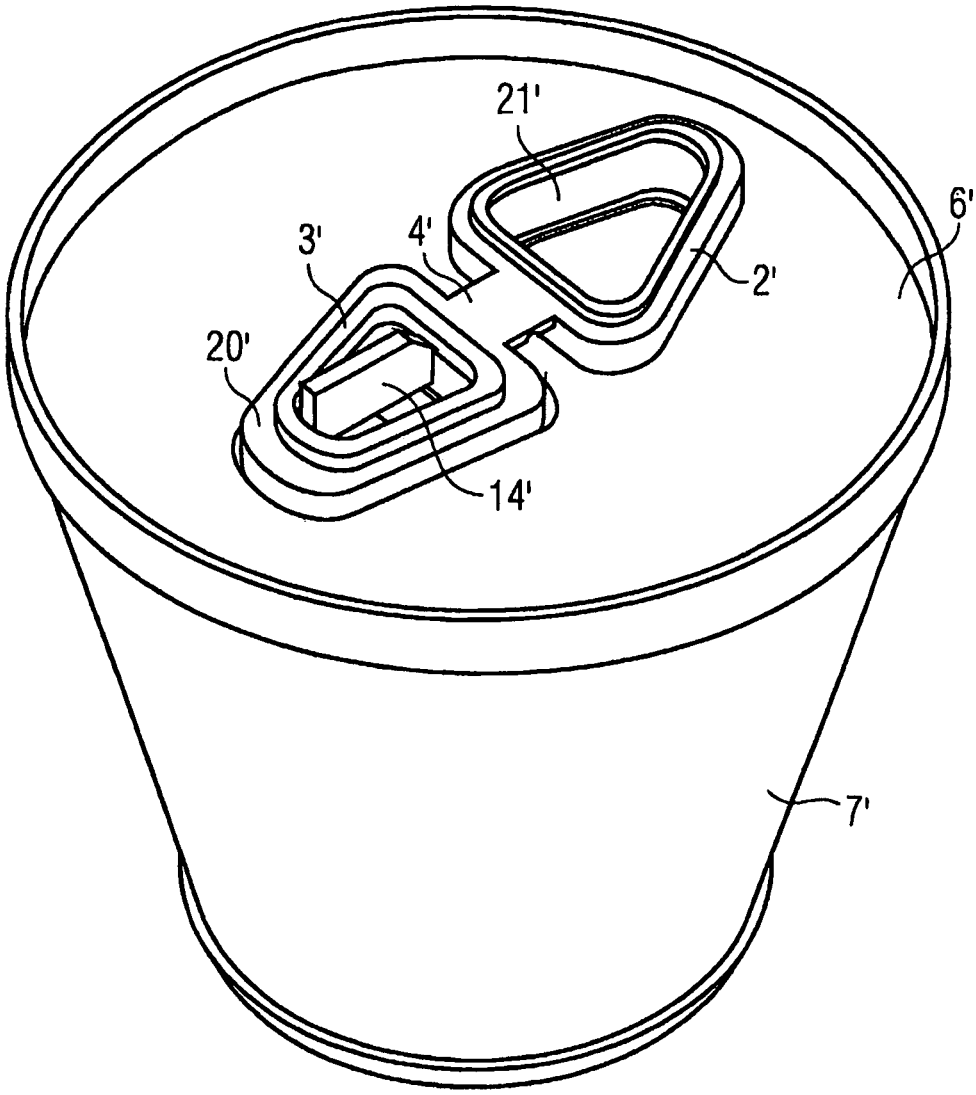
FIG. 6 shows a milk can having a can closure according to the present invention in a transport position.
Figure 7:
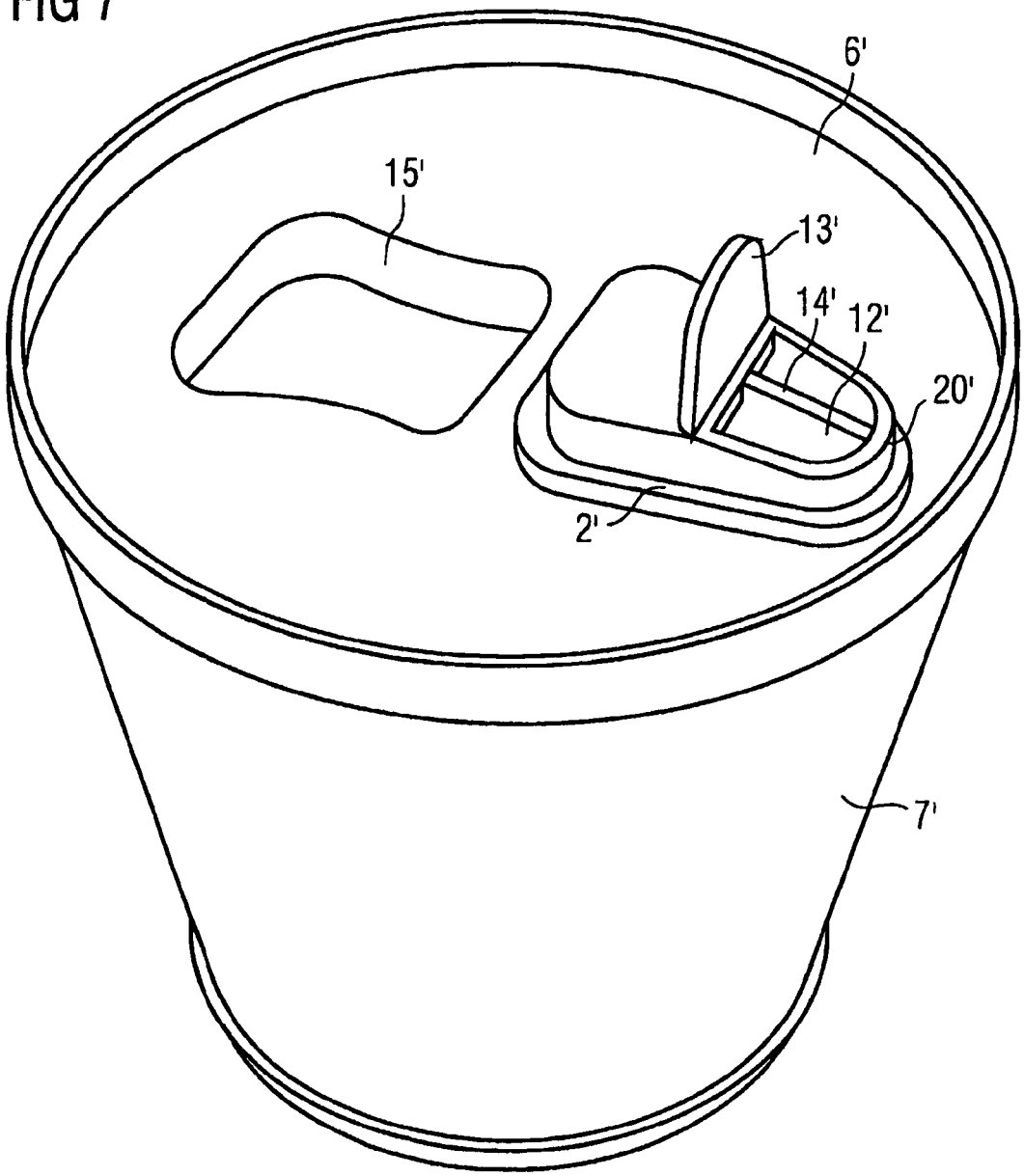
FIG. 7 shows the milk can from FIG. 6 in a usage position.

In the usage position of the can 7 shown in FIGS. 4 and 5, the closure lid 3 is removed from the depression 15 of the can lid 6 by pulling on the piercing rib 14 and pivoted in the direction toward the closure bottom 2. During this procedure, the cover 9 is pressed far enough in the direction of the can interior because of its intended break points 10, using the piercing rib 14, which has a bevel 16 (see FIG. 3) in the region of the joint 4, until the cover 9 comes to rest on the bevel 16 of the closure lid 3. The cover 9 pivots at the same time around the region 8 between the closure bottom 2 and the cover 9. In this state, the closure lid 3 engages with the closure bottom 2.

Furthermore, a peripheral catch edge 17 positioned on the closure bottom 2 may be seen from FIG. 5, which cooperates with a catch receiver 18, which is also peripheral, positioned on the closure lid 3.

The pouring opening 12 in the closure lid 3 is covered using a closure flap 13 which allows reclosure. In the usage position of the can 7 shown in FIGS. 4 and 5, the liquid provided in the can 7 may be removed via the pouring opening 8 and the pouring opening 12, the metering of the liquid able to be influenced by the piercing rib 9. After the emptying procedure has ended, the pouring opening 12 of the closure lid 3 is covered using the closure flap 13. This closure flap 13 may also be pivotably connected to the closure lid 3 via a film hinge 19 and engages with closure lid 3 when it is pressed on.

For more comfortable handling, the closure lid 3 also has a handle-like projection 20, using which the closure lid 3 may be removed from the closure bottom 2 again.

The exemplary embodiment of a can closure 1' according to the present invention illustrated in FIGS. 6 to 13 largely corresponds with the exemplary embodiment described above and illustrated in FIGS. 1 through 5, so that in the following reference is largely made to the above description to avoid repetition and the same reference numbers are used for corresponding components, which are identified only by an apostrophe for differentiation.

A special feature of this exemplary embodiment is that a slotted depression 21' is positioned in the closure bottom 2', which is covered on its lower side by a cover 22' before the initial opening, the cover 22' being connected by intended break points to the closure bottom 2'. When the closure lid 3' is pivoted from the transport position illustrated in FIGS. 6, 8, 9, and 10 into the usage position illustrated in FIG. 7, the piercing rib 14' is inserted into the slotted depression and breaks the intended break points between the cover 22' on the lower side of the slotted depression 21' and the closure bottom 2', through which a pouring opening is exposed.

Figure 8:
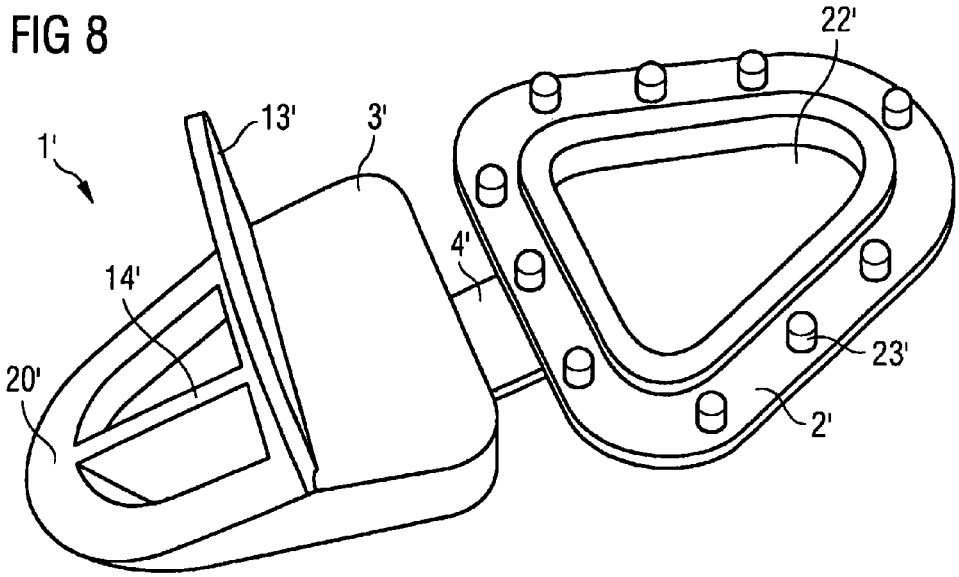
FIG. 8 shows a bottom view of the can closure of the milk can from FIGS. 6 and 7 in the opened state.
Figure 9:
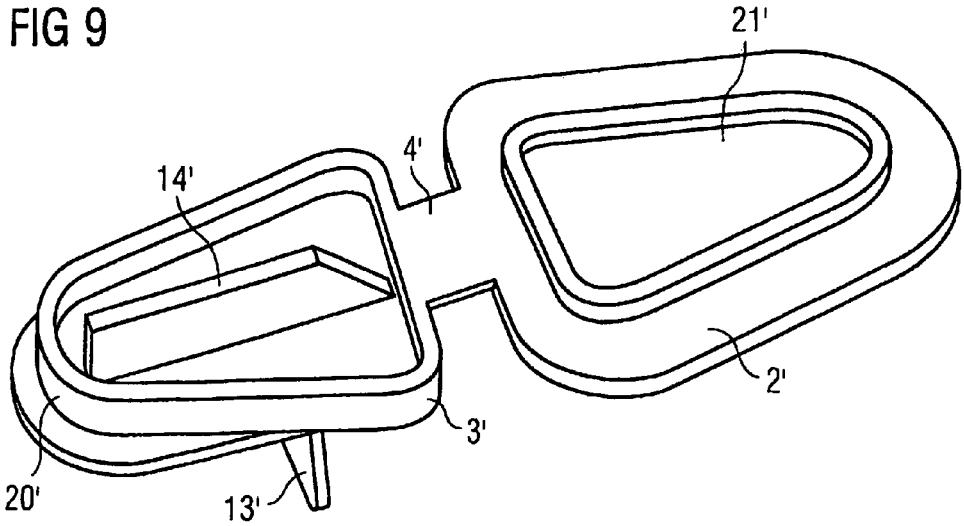
FIG. 9 shows a perspective top view of the can closure from FIG. 8.
Figure 10:
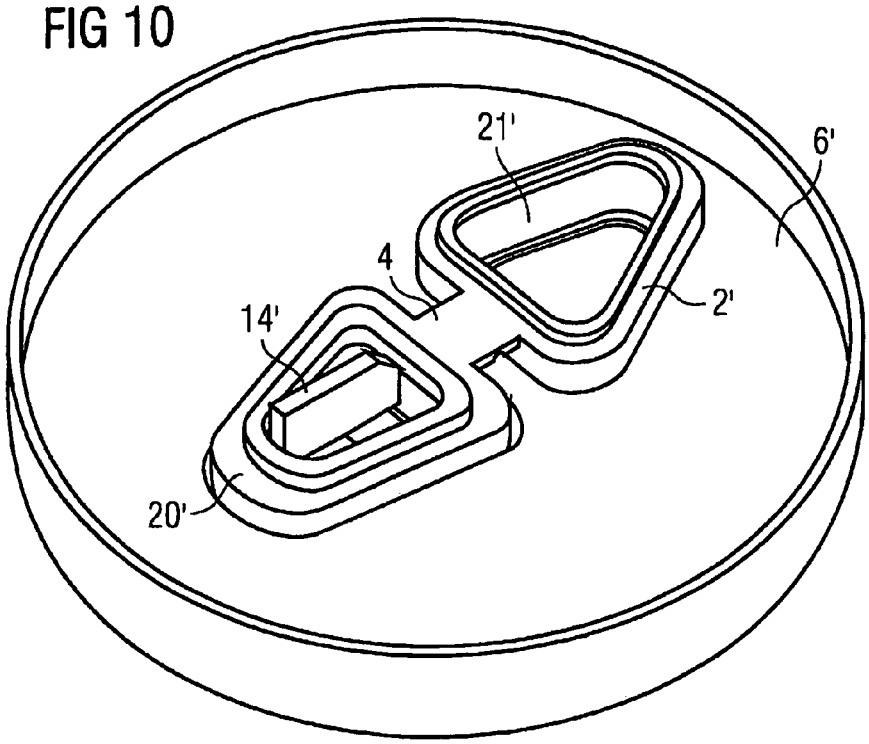
FIG. 10 shows a can lid having a can closure according to the present invention in the transport position.
Figure 11:
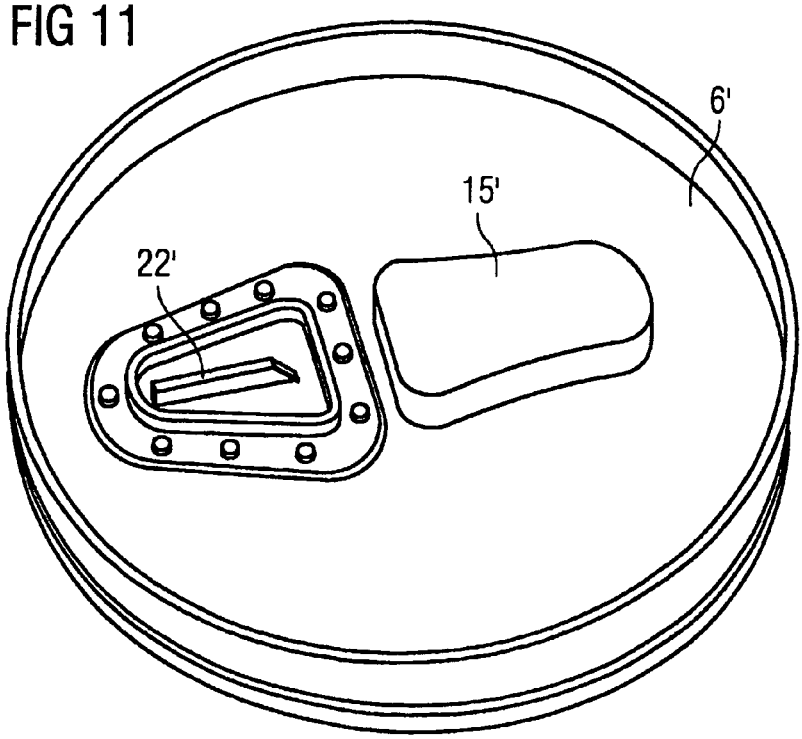
FIG. 11 shows a bottom view of the can lid from FIG. 10.
Figure 12:
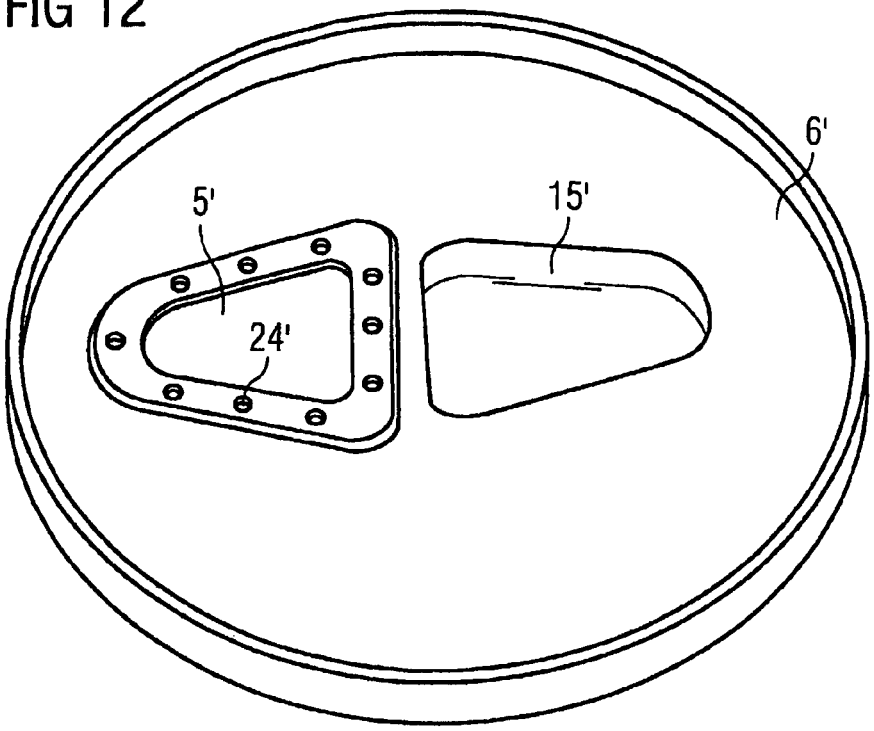
FIG. 12 shows a perspective top view of the can lid from FIGS. 10 and 11 with the can closure removed.
Figure 13:
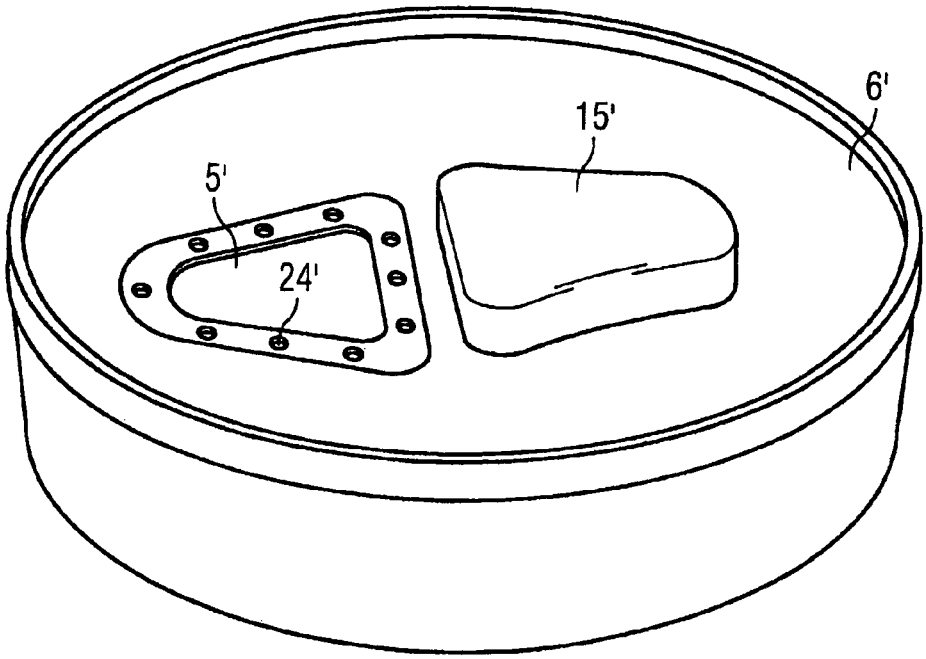
FIG. 13 shows a perspective bottom view of the can lid from FIG. 12.
Figure 14:
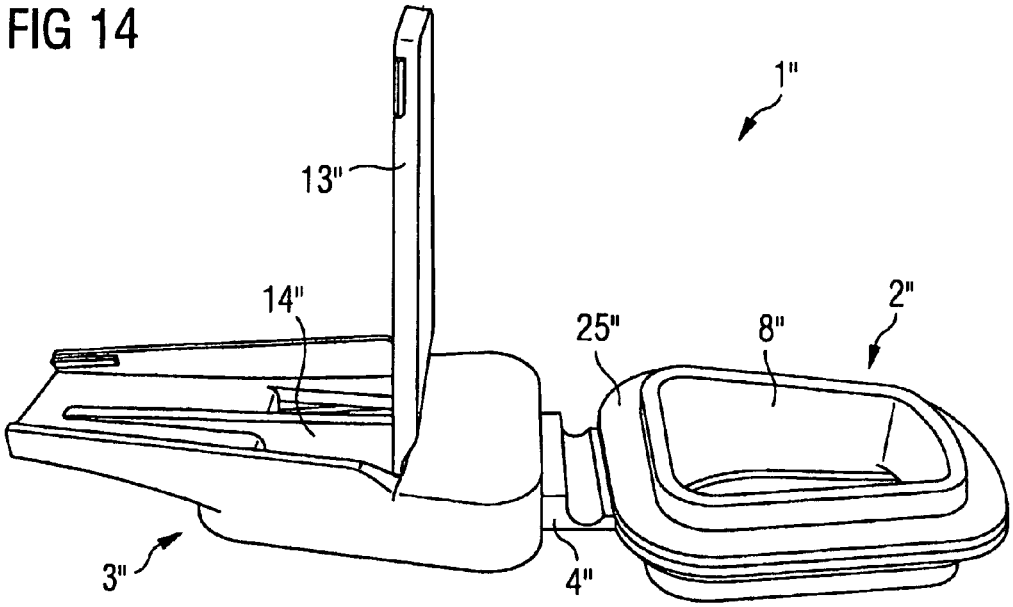
FIG. 14 shows a perspective view of an alternative exemplary embodiment of the can closure according to the present invention.

In addition, it may be seen from FIG. 8 that small protrusions 23' are molded onto the lower side of the closure bottom 2', which, in the mounted state, engage in corresponding depressions 24', which are attached in the closure lid 3' in the edge of the cutout 5' for the closure bottom 2', as may be seen from FIGS. 13 and 14 in particular. The protrusions 23' on the closure bottom 2' result in a form-fitting connection in combination with the holes 24' in the closure lid 3'.

Figure 15:
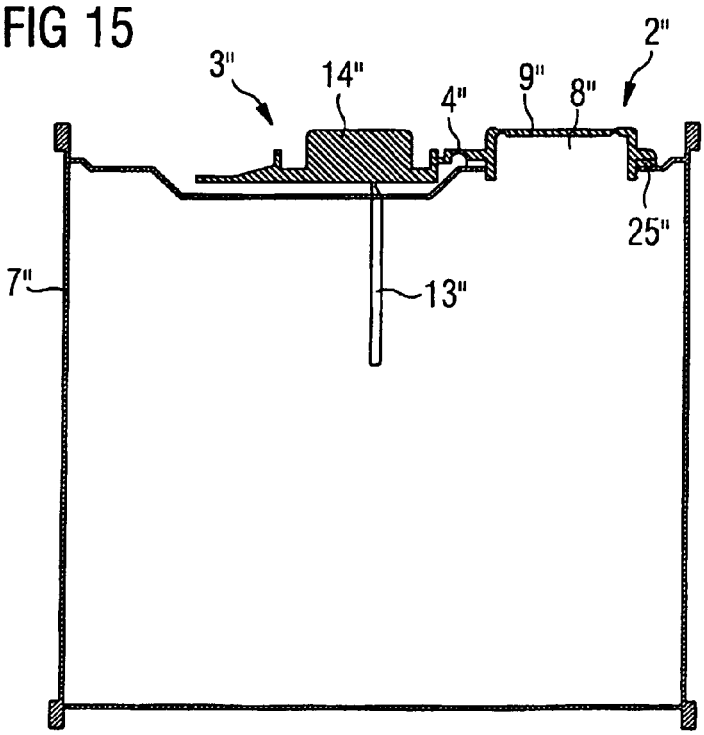
FIG. 15 shows a cross-sectional view of the can closure from FIG. 14 in the mounted state on a can.

The exemplary embodiment of a can closure 1" according to the present invention illustrated in FIGS. 14 and 15 largely corresponds to the exemplary embodiments described above, so that reference is made to the above description to avoid repetition and the same reference numbers are used in the following for corresponding components, which are only identified by two apostrophes for differentiation.

A special feature of this exemplary embodiment is that the closure bottom 2" comprises two plastic opponents which have different hardnesses. The harder plastic component forms a gasket 25" for this purpose, which rests on the edge of the cutout in the can lid in the mounted state and thus seals the cutout.

In addition, the gasket 25" also prevents corrosion at the edge of the cutout of the closure lid because the gasket 25" encloses the cutout edge. This is advantageous because stamping out the cutout damages the protective lacquer layer on the can sheet metal and therefore makes it susceptible to corrosion.

The present invention is not restricted to the preferred exemplary embodiments described above. Rather, multiple variations and alterations are possible, which also make use of the ideas according to the present invention and therefore fall within the scope of protection.

LIST OF REFERENCE NUMBERS

1, 1', 1" can closure
2, 2', 2" closure bottom
3, 3', 3" joint
5, 5' cutout
6, 6' can lid
7, 7', 7" can
8, 8', 8" pouring opening
9, 9', 9" cover
10, 10' intended break points
11 film hinge
12, 12' pouring opening
13, 13', 13" closure flap
14, 14', 14" piercing rib
15, 15' depression
16, 16' bevel of the piercing rib
17, 17' catch edge
18, 18' catch receiver
19, 19' film hinge
20, 20' projection
21' depression
22' cover
23' protrusions
24' depressions
25" gasket

The invention claimed is:

1. A can closure being mountable in a can lid and operated manually without tools, the can closure at least partially comprising plastic and capable of insertion into a cutout in the can lid, the can closure sealing the cutout in the can lid, said can closure comprising:

a) a closure bottom
- a1) wherein said closure bottom is adapted to be inserted into the cutout in the can lid and connected in a form-fitting way to the can lid,
- a2) said closure bottom comprising a first pouring opening being positioned in the closure bottom,
- a3) said closure bottom comprising a cover closing the first pouring opening before an initial opening, wherein the cover has at least one intended breaking point, b) a closure lid,
- b1) said closure lid having means to open the first pouring opening in the closure bottom in a usage position of the closure lid by breaking the intended breaking point in the cover in the closure bottom,
- b2) said closure lid comprising a second pouring opening which lies above the first pouring opening in the closure bottom in the usage position of the closure lid,
- b3) said second pouring opening being positioned, in the usage position, within the closure lid at an outer side of the closure lid, c) a first joint connecting the closure lid to the closure bottom, so that the closure lid is pivotable from a transport position into a usage position, d) a closure flap for closing the second pouring opening in the closure lid, wherein the closure flap is reclosable, and e) a second joint pivotably connecting the closure flap to the closure lid, said second joint being positioned, in the usage position, at an inner side of the closure flap.

2. The can closure according to claim 1, wherein the first pouring in the closure bottom and the second pouring opening in the closure lid are spaced apart from the can lid in a mounted state.

3. The can closure according to claim 1, wherein the means to open the first pouring opening is positioned so as to at least partially overlap the second pouring opening.

4. The can closure according to claim 1, wherein the closure lid has a piercing rib positioned on the lower side of the closure lid as means for opening the first pouring opening positioned in the closure bottom.

5. The can closure according to claim 4, wherein the piercing rib has a bevel on the side facing toward the joint.

6. The can closure according to claim 1, wherein the closure lid has a handle-like projection, in order to remove the closure lid from the usage position.

7. The can closure according to claim 1, wherein a surface contour is provided on the can closure's lower side or on the lower side of the closure bottom, in order to produce a form-fitting connection to a corresponding surface contour on the can lid during a plastic injection procedure.

8. The can closure according to claim 1, wherein the closure bottom and the closure lid have catch elements, in order to produce a catch connection between the closure bottom and the closure lid in the usage position of the closure lid.

9. The can closure according to claim 1, wherein an ultrasonic weld is provided for the connection to the can lid.

10. The can closure according to claim 1, wherein the closure bottom comprises a harder component and a softer component, the softer component pressing against the edge of the cutout in the can lid as a gasket in a mounted state.

11. The can closure according to claim 10, wherein the softer component of the closure bottom encloses the edge of the can lid in the mounted state.

12. A can having a can closure according to one of claims 1-5 and 6-11.

* * * * *